United States Patent [19]

Evers et al.

[11] 4,274,553

[45] Jun. 23, 1981

[54] SAFETY SPRAYING DEVICE

[75] Inventors: Heinz Evers, Dillenburg; Hartmut Goedecke, Weilburg-Kubach, both of Fed. Rep. of Germany

[73] Assignee: Frank'sche Eisenwerke AG, Niederscheld, Dillkreis, Fed. Rep. of Germany

[21] Appl. No.: 58,708

[22] Filed: Jul. 18, 1979

[30] Foreign Application Priority Data

Jul. 26, 1978 [DE] Fed. Rep. of Germany ..... 2832771

[51] Int. Cl.[3] ..... B67D 5/08

[52] U.S. Cl. ..... 222/76; 307/350

[58] Field of Search ..... 222/76; 307/234, 350, 307/318, 358

[56] References Cited

U.S. PATENT DOCUMENTS

| | | | |
|---|---|---|---|
| 3,558,916 | 1/1971 | Horn | 307/234 |
| 3,573,492 | 4/1971 | Bridgewater | 307/234 |
| 3,805,090 | 4/1974 | Kaiser | 307/318 |
| 4,162,042 | 7/1979 | Mommsen et al. | 222/76 X |

*Primary Examiner*—Joseph J. Rolla

*Attorney, Agent, or Firm*—Sughrue, Rothwell, Mion, Zinn and Macpeak

[57] ABSTRACT

A spraying device for cleaning apparatus, plant protecting apparatus or the like including a hand tool connected via a conduit to a pressure and heat generator for providing a liquid or vaporous agent under high pressure. A switch lever is held in the on position during operation. The lever controls a switch, the activation of which causes a transmitter for electric or electromagnetic waves arranged in the hand tool to send a switch-on command to a receiver located near the pressure and heat generator. The receiver operates a switch for controlling the pressure and heat generator, whereby upon release of the hand tool, such as unintentionally in the case of a dangerous condition, the switch-on command of the transmitter is interrupted and the pressure and heat generator switched off.

13 Claims, 2 Drawing Figures

SAFETY SPRAYING DEVICE

BACKGROUND OF THE INVENTION

Spraying device incorporating safety features have already been suggested. However, most attempts to provide safety features have centered upon the use of protective insulation, neutralization or the use of a protective ground.

With the spraying device of the invention the risk of injury upon unintentional or accidental release of the sprayer is reduced in that discharge of the sprayed agent is halted. The spraying device of the invention requires no mechanical cut-out means in the hand tool the operation of which could be adversely affected by abrasive or corrosive agents, high temperatures and high pressures. For the control of the pressure and heat generator via the hand tool, low voltages and little power may be used. Thus, the cost of protective insulation, neutralization or a protective ground in prior art devices is entirely eliminated. Moreover, an additional conductor in the high-pressure hose for transmitting the control voltage is not required. With the spraying device disclosed and claimed herein the pressure and heat generator can be switched off safely and quickly by preventing pressure peaks in those components carrying or storing the agents.

It is particularly an object of the present invention to provide a spraying device of the kind as herein described which cannot be actuated by coupled interference voltages.

SUMMARY OF THE INVENTION

This object, as well as others, is realized by the invention in that between the output of the transmitter and the input of the receiver there is arranged a variable resistor for signal attenuation, the resistance value of the variable resistor being determinable by an output signal from an amplifier of the receiver in dependence upon a received input signal. The output signal of the amplifier is transmitted to the switch for switching the pressure and heat generator on and off via a connection means that will couple through the signal via other elements only after a minimum duration time.

The pressure and heat generator is switched on only if the switch-on command is of a predetermined minimum duration. Thus the influence of the mostly short-lived interference voltage transients, caused by switching operations when actuating switches, contractors, relays, etc., can be suppressed. As the received signals are attenuated, only those signals that have a minimum energy as determined by the setting of the variable resistor can trigger the switching-on. The coupled-in interference voltages for the most part have only a small energy content, which results in additional safety protection against interferring voltages. Therefore, the spraying device of the invention can be readily and safely employed in most industrial plants.

In a practical embodiment, the variable resistor is a diode or Zener diode device, one terminal of which is at a reference potential, to which the receiver is connected by means of a capacitor and by means of an amplifier configured as a D.C. amplifier. This arrangement attenuates input signals of a wide frequency spectrum so that the influence of high-frequency and low-frequency interference signals is suppressed.

In a preferred embodiment, the conduit for transporting the agent to the hand tool is configured as a wire-armoured tube, the metallic endpiece of which faces the pressure and heat generator. An insulating body is mounted on the housing and is connected via a conduit to the receiver input. A section of textile tube is arranged around the tube end. With this arrangement, the switch-on command is transmitted over the wire mesh of the wire-armoured tube. Wireless transmission is not required. Thus, interference problems with radio and television reception can be avoided.

A particularly advantageous embodiment is constructed in such a manner that one end of the wire-armoured tube facing the hand tool is connected to the metallic jet pipe of the hand tool by means of an insulating component, such as a piece of canvas tube, and to one output of the transmitter, while the other output of the transmitter is connected to the fully or partially metallic handle of the hand tool. This arrangement makes possible the transmission of the switch-on command signal over the wire mesh and the operator or ground connection to the receiver.

In another preferred embodiment, the transmitter has two oscillators which simultaneously oscillate at different frequencies, with one of these, connected to the carrier signal input and the other to the modulation signal input of a modulator. With this arrangement, the switch-on command signal is transmitted by means of a frequency-modulated or amplitude-modulated oscillation. It is preferable to use a frequency-modulation as this modulation technique is generally less susceptible to distortion problems.

Preferably, the hand tool comprises a second switch with two or more positions, whereby various frequencies of the second oscillator can be set by the different positions of the switch. With this arrangement, several commands can be transmitted from the hand tool to the pressure and heat generator. These commands may for example represent different temperatures, pressures, or different admixture ratios of the chemicals.

In another practical embodiment, a demodulator for the frequency of the second oscillator is arranged between the receiver input and the amplifier. The demodulator reacts to the frequency of the second oscillator and transmits a corresponding output signal to the control elements for the pressure and heat generator. This arrangement provides an additional safeguard against the influence of interfering voltage transients.

Still another preferred embodiment includes a filter following the receiver input which passes the frequencies of the first and second oscillators. The output of the demodulator is connected to parallel filters, the output filtered frequencies of which are the same as the frequencies that can be generated by the second oscillator. With this arrangement, the apparatus can be switched on only if both oscillators are in operation and one of the other filters is passing the frequency controlling the switch-on command. The signals of the remaining frequencies can be used for controlling selected functions of the pressure and heat generator.

After switching-off, such as caused by releasing the hand tool, unintentional switching-on caused by interfering signals is prevented not only by the limiting conditions due to the energy content requirements and the minimum duration time, but also by the tuning of the filter to the frequency of the transmitter.

Moreover, coding means may be arranged before the input of the modulation stage and a decoding stage is provided reacting only to the code of the coding means in the transmitter in the receiver following. By actuating the hand tool, the switch-on command is transmitted to the receiver in coded form. Only if the coded command signal is not altered by interfering signals will an identification of the command signal and connecting of the pressure and heat generator take place. In this manner it is possible to prevent unintentional switching-on caused by short-duration transients. The hand tool may also include a second switch with two or more positions, so that, by means of the different switching positions, various codes can be utilized in the coding system. In the receiver following the demodulator there are provided several decoding stages of which only one will react each time to the code that is set by the switch in the hand tool.

In still another embodiment, the switch in the hand tool is operatively coupled to the power supply leads of both oscillators. Upon opening of the switch when the hand tool is released, the power supply is interrupted whereupon the oscillators will immediately cease producing their output signals. This results in an immediate switching-off of the pressure and heat generator.

Further details, characteristics and advantages of the invention will be apparent from the following description of a drawing of an embodiment example.

DESCRIPTION OF THE PREFERRED EMBODIMENTS

Figure 1:
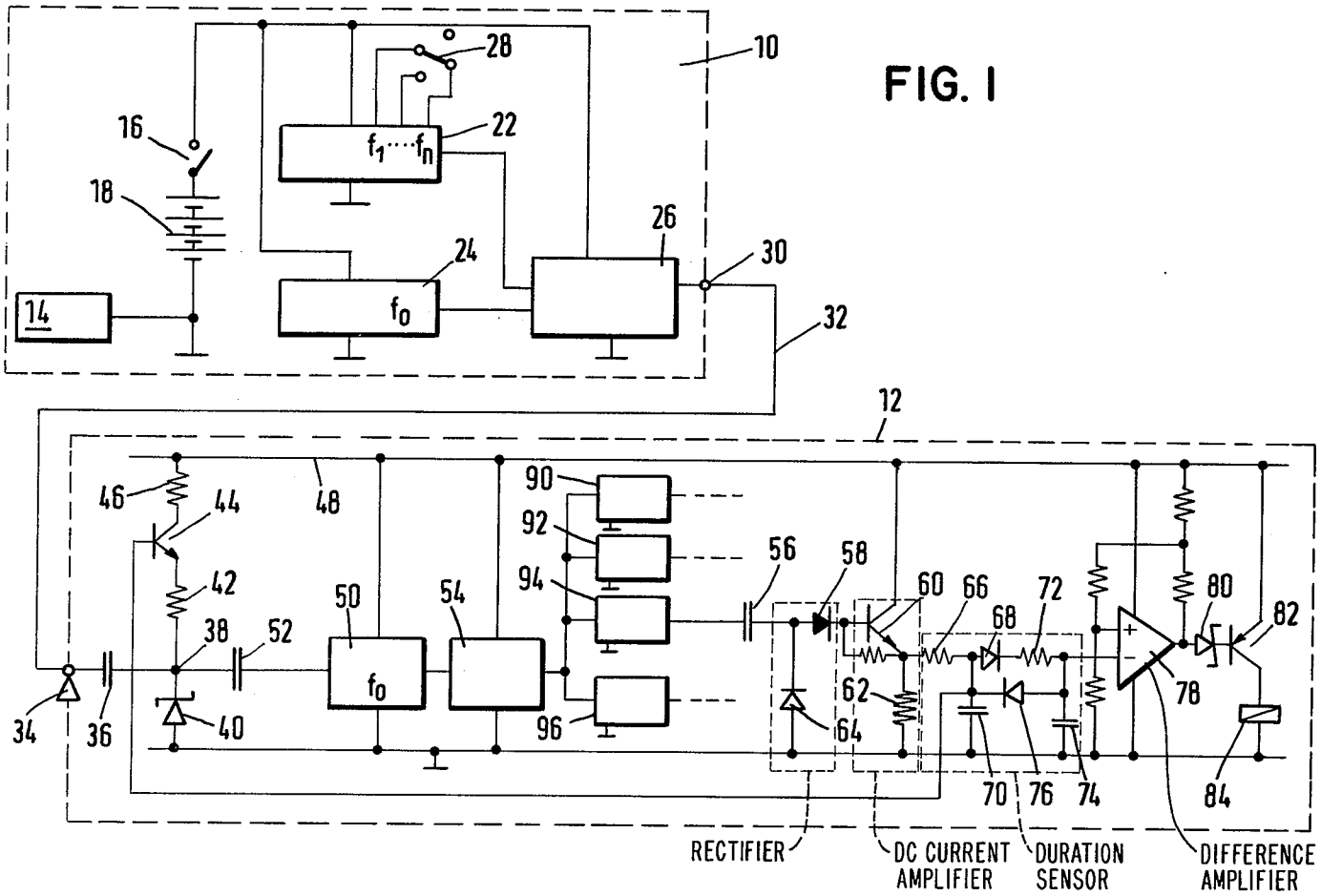
FIG. 1 shows a schematic diagram of circuits for implementing the present invention.

FIG. 1 shows a diagram of the circuits in the transmitter of the hand tool for producing the switch-on command, and of the receiver circuits at the pressure and heat generator together with the components controlling the energy supply to the pressure and heat generator.

Figure 2:
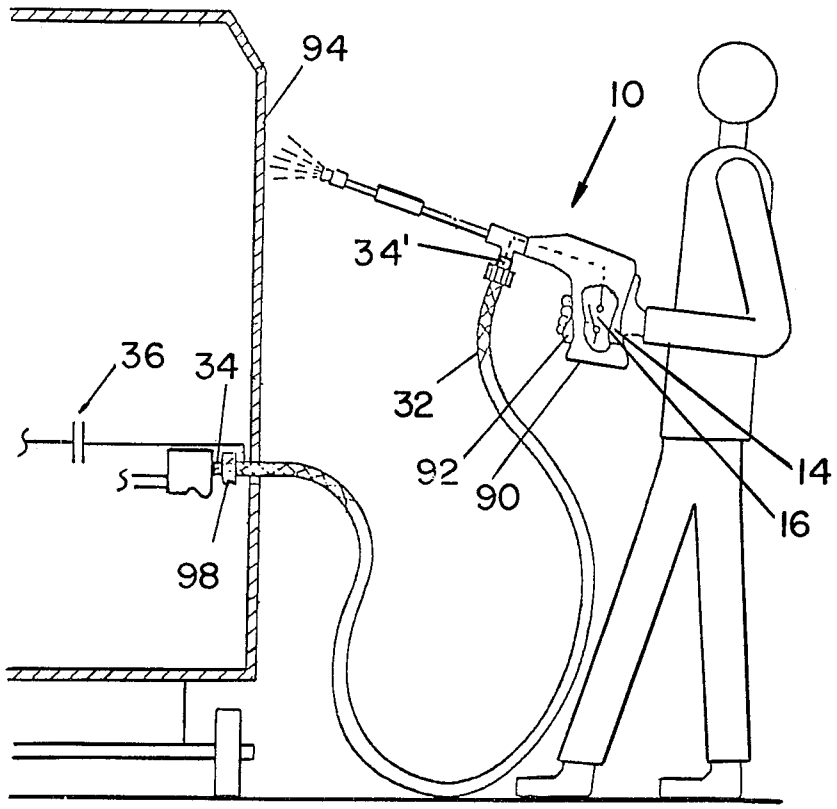
FIG. 2 illustrates the apparatus embodying the circuitry of FIG. 1.

In FIG. 1, the circuits of hand tool 10 are shown within the lines of a broken line rectangle. A pressure and heat generator 12, such as a steam jet cleaning apparatus or a high-pressure washer, is likewise indicated in FIG. 1 by a broken line rectangle. Hand tool 10, which may have the form of a spraying gun, as seen in FIG. 2 has a pistol handle 90 into which a metal plate 14 is embedded. A switch lever 92 which controls a switch 16 is located on the pistol handle for operating hand tool 10. If the operator pulls the switch lever in direction of the pistol handle, switch 16 closes. After releasing the switch lever, the switch 16 opens.

Inside hand tool 10, as seen in FIG. 1, there is provided a battery 18 which furnishes power to oscillators 22, 24 and a modulation stage 26. The return circuit for the operating current includes metal plate 14. In the drawing, this is shown by the return connection of the oscillators 22, 24 and the modulation stage 26 as well as the metal plate 14 which is grounded. Switch 16 is connected between battery 18 and the input of the oscillator 24.

First oscillator 24 generates a periodic signal with a frequency $f_0$ for example 100 kilohertz. The output signal of the oscillator 24 is coupled to modulation stage 26.

Second oscillator 22, which is, for example, configured as an astable multivibrator, likewise produces a periodic signal. Connected to the oscillator 22 is a switch 28 which has several switching positions which are not specifically identified. For the various switching positions, values corresponding to the frequency of oscillator 22 are individually set. Thus, each switching position corresponds to a different frequency. In accordance with the number of positions of switch 28, oscillator 22 can produce various frequencies $f_1 \ldots f_n$, which are lower than the frequency $f_0$.

The output of oscillator 22 is connected to the modulation input of modulation stage 26. According to the connection arrangement, modulation stage 26 will generate either an amplitude-modulated or a frequency-modulated oscillation signal. The output 30 of the modulation stage 26 is connected to one end of a wire-armoured tube 32 as seen in FIG. 2. In FIG. 1, the wire armouring is shown as conductor 32. The outlet for the return wire of the working current of modulation stage 26 is connected to metal plate 14. Metal plate 14 and a metallic jet pipe are electrically connected with each other. In another embodiment, the jet pipe is connected to the tube rather than the handle.

The other end of the wiring armouring is connected to an insulating body 34 arranged at the housing 94 of pressure and heat generator 12. Both ends of the wire armouring can be configured as metallic endpieces 98. The wire armouring is separated from the jet pipe by an insulating piece 34' which can be a piece braided hose. The second end of the wire armouring is not connected to the pressure and heat generator 12 system but is separated from the last component thereof as viewed from the flow direction of the agent by a section of such hose.

As seen in FIG. 1, conductor 32 is connected to input 38 of the receiver via insulating body 34 to which a not specifically marked conduit is connected along with a capacitor 36. At the input of receiver 38 there is further arranged a variable resistor 40 which is preferably a Zener diode device. The amplitude of the signal transmitted from output 30 is affected by resistor 40 arranged between the transmitter, including oscillators 22, 24 and modulation stage 26, and the receiver. While one terminal of Zener diode or resistor 40 is connected to the receiver input 38, the other terminal is coupled to the ground of pressure and heat generator 12. Further, receiver input 38 is connected via a resistor 42 to the emitter of a transistor 44, the collector of which being connected through resistor 46 to a terminal 48 of the power source. The receiver includes a filter 50 and a capacitor 52 coupled between receiver input 38 and the filter input. Filter 50 feeds a demodulator 54. Filter 50 can be an active filter so that amplification of the oscillations is simultaneously effected. Filter 50 is adjusted to the modulated oscillation frequency generated by the transmitter. A filter, which 94 is connected to the output of demodulator 54, is adjusted to frequency $f_1$. Further filters can be connected in parallel as these filters are adjusted to the other oscillation frequencies produced by oscillator 22. Following these filters there are connected gating connections for the signals transmitted by the respective oscillations. The drawing shows demodulator 54 and filters 90, 92, 94, 96 at the outputs of which the adjustable frequencies of oscillator 22 appear. The output signal of filters 90, 92, 94 and 96 are coupled through a capacitor 56 and a diode 58 to the base of a transistor 60, the collector of which connected to terminal 48, while the emitter is connected via a resistor 62 to ground. Between the anode of the diode 58 and the reference potential there is coupled another diode 64, the anode of which is coupled to ground. A resistor is coupled between the emitter of transistor 60 and its base. A resistor is connected to the emitter of transistor 60 through which current is supplied to a diode 68. The connection point between one terminal of resistor 66 and the anode of rectifier diode 68 is connected both to the base of transistor 44 and to a capacitor 70.

Resistor 72 follows the cathode of rectifier diode 68, to which a capacitor 74 is connected. Another diode 76 is coupled between capacitor 70 and 74, the polarity of which is opposite that of diode 68.

Current is fed through resistor 72 to the inverting input of a difference amplifier 78. The non-inverting input of difference amplifier 78 is connected to a resistance network disposed between terminal 48 and the ground connection of pressure and heat generator 12. The individual elements of the resistance network, including also a resistor connected to the output of the difference amplifier, are not specifically indicated. Furthermore, the output of difference amplifier 78 is coupled through a Zener diode 80 to the base of a transistor 82 in its collector circuit to which a relay 84 is connected for controlling a contactor in the current supply line for the pressure and heat generator. This contactor is not shown.

For switching-on the pressure and heat generator 12, switch 16 must be closed by actuating the switch lever on the pistol handle of hand tool 10. Current is supplied through the closed switch 16 to oscillators 22, 24 and modulation stage 26 whereupon oscillators 22, 24 produce signals with the frequencies $f_1$ or $f_0$, respectively. Hereby it is assumed that switch 28 is in the position corresponding to frequency $f_1$ and that the switch-on control signal corresponds to this frequency. Modulation stage 26 transmits a modulated oscillation signal to conductor 32, to filter 50 via capacitor 36 and receiver input 38. Filter 50, tuned to the modulated oscillation, will suppress other frequencies and thereby prevent interfering signals with frequencies different from $f_1$ and $f_0$ from influencing the pressure and heat generator. Thus, protection against interfering signals is already achieved. Demodulator 54 emits a signal with the frequency $f_1$ which is rectified by the diodes 58 and 64 and amplified by the transistor 60. This D.C. signal serves both to charge capacitors 70 and 74, and to control transistor 44.

The signal with frequency $f_1$ must have a certain minimum duration which is dependent on the time constant of the combination comprising the resistors 66 and 72 and the capacitors 70 and 74 before it will be coupled through to the subsequent circuits. This isolates the influence of very short-lived interfering impulses from the switch-on operation of pressure and heat generator 13.

If the signal is present at receiver input 38 in excess of the minimum period, transistor 60 will supply base current to the transistor 44. Transistor 44 is then put in a condition of high conductivity. Accordingly, a sufficiently high current is supplied to Zener diode device 40, to cause a potential drop corresponding to its breakdown voltage. As soon as the Zener diode device is operating in the vicinity of its characteristic voltage, signals reaching receiver input 38 will be more strongly attenuated. Therefore, signals with little energy content will not be coupled through by the receiver to after-connected elements. Signals transmitted over conductor 32 must have a certain minimum energy content in order to activate switching-on of pressure and heat generator 12. This can easily be achieved by an appropriate selection of the values of the elements of the transmitter. Interference voltages of little energy content will not influence the switching behavior or the pressure and heat generator.

If the signals on the conductor have the minimum duration time fixed by the receiver switching as well as the minimum energy content and frequency $f_0$ modulated by a frequency $f_1$, then the signal level at the inverting input of the difference amplifier 78 will be sufficient to switch over the output signal to the more negative value. As a result, the Zener diode device 80 will conduct and thus turn on transistor 82 which supplies current to relay 84. Therefore the relay 84 is activated which in turn actuates the contactor (not shown), which couples a working potential to the components controlling the pressure and heat generation.

Upon release of the pistol handle, switch 16 will open. Working voltage is thereby removed from oscillators 22, 24 and modulation stage 26 so that the receiver will no longer receive an input signal. Capacitors 74 and 70 will discharge in a short time through resistors 62 and 66. Difference amplifier 78 thereby switches over to a high output voltage which turns off transistor 82. Relay 84 then opens opening the contactor contacts. The pressure and temperature controlling components are accordingly deactivated so that transport of the agent is interrupted.

After switching-off, interfering signals cannot switch-on pressure and heat generator 12 due to the advantageous circuit arrangement explained above so that the device may operate without failure and may operate safely even in the presence of frequently-occurring interference signals.

The power connections for pressure and heat generator 12 as shown in the drawing, with the exception of the power feed line for the remainder of the system are supplied by a power supply operating from the power mains (not shown in detail), which provides a supply voltage independent of the remainder of the system. Terminal 48 of this power supply, which may for example be at a D.C. voltage of 24 V, feeds power during both the switched-off and switched-on conditions to the receiver including components 50 to 62, the connection at receiver input 38 including elements 40 to 46, and components 66 to 84 connected to the output of D.C. current amplifier 60, 62.

Other embodiments of the invention are also anticipated. For example oscillator 22 and filters 90, 92, 94, 96 can be replaced by a decoding system decoding stages.

What is claimed is:

1. A spraying device for cleaning apparatus, plant protecting apparatus or the like, comprising a hand tool connected to a pressure and heat generator by conduit means for distributing a liquid or vaporous agent under high pressure; a switch lever adapted to be held in an on position during operation, said switch lever controlling a switch for actuating a transmitter of electric or electromagnetic waves being arranged in the hand tool, said transmitter upon actuation sending a switch-on command signal to a receiver arranged at said pressure and heat generator, said receiver including a switch for controlling said pressure and heat generator, whereby upon release of said lever such as when said hand tool is unintentionally released in the event of danger, said switch-on command signal is interrupted and said pressure and heat generator switched off, variable resistor means disposed at the input of said receiver (50–62) between the output of said transmitter (22, 24, 26) and the receiver, the resistance of said variable resistor means being varied in accordance with an output signal of an amplifier (60, 62) of said receiver in accordance with an input signal for determining input signal attenuation, said output signal of said amplifier being coupled to means (68, 72, 74) for coupling through said input signal only after a minimum duration time, and means (78, 80, 82, 84) for coupling said input signal to said switch for controlling said pressure and heat generator (12).

2. A spraying device according to claim 1, wherein said variable resistor (40) comprises a Zener diode device, one terminal thereof being at a reference potential, said receiver being coupled to said terminal through a capacitor (52) and said amplifier (60, 62), said amplifier being configured as a D.C. amplifier.

3. A spraying device according to claim 2, wherein said conduit means comprises a wire-armoured tube having a metallic endpiece facing said pressure and heat generator (12) connected to an insulating body (34) fixed on a housing of said pressure and heat generator, said conduit being coupled to said receiver input (38), and a section of insulating hose arranged before said pressure and heat generator.

4. A spraying device according to claim 3 wherein one end of said wire-armoured tube disposed towards said hand tool is connected to a metallic jet pipe of said hand tool (10) by an insulating piece comprising a section of insulating hose and to one output (30) of said transmitter (22, 24, 26) while another output of said transmitter is connected to a fully or partially metallic handle of said hand tool (10).

5. A spraying device according to claim 1 wherein said transmitter (22, 24, 26) comprises two oscillators (22, 24) simultaneously oscillating at different frequencies ($f_1$ $f_0$), whereby a first one of said oscillators is coupled to a carrier signal input of a modulation stage (26) and the other one of said oscillators is coupled to a modulation input of said modulation stage (26).

6. A spraying device according to claim 5, wherein the oscillator (22) oscillating with a frequency ($f_1$) comprises a frequency demultiplier for decreasing the frequency ($f_0$) of the other oscillator (24).

7. A spraying device according to either of claims 5 or 6 further comprising a second switch (28) having two or more switching positions and arranged in said hand tool (10), the frequency of said second oscillator (22) being determined in accordance with positions of said second switch.

8. A spraying device according to claim 5 wherein a demodulator (54) for the frequency of the second oscillator (22) is arranged between said receiver input (38) and said amplifier (60, 62).

9. A spraying device according to claim 8 further comprising a filter (50) for passing the frequencies of the first and second oscillators (22, 24) connected after the receiver input (38), and a plurality of parallel filters (90, 92, 94, 96) coupled to an output of said demodulator of which the filtered frequencies correspond to frequencies generated by said second oscillator (22).

10. A spraying device according to claim 5 further comprising coding means arranged before the input of said modulation stage (26), and decoding means (94) within said receiver following said demodulator (54), said decoding means producing outputs in response to the code of said coding means.

11. A spraying device according to claim 10, wherein said hand tool (10) comprises a second switch (28) having two or more positions, the code produced by said coding means being determined in accordance with switching positions of said switching means.

12. A spraying device according to claim 11 wherein said decoding means comprises a plurality of decoding stages (40, 92, 94, 96) arranged in said receiver following said demodulator (54), only a single of said said stages reacting to the code set by said switch (28) in said hand tool (10).

13. A spraying device according to claim 5 wherein said first-mentioned switch (16) is operatively coupled to a terminal of a power supply for said two oscillators (22, 24).

* * * * *